US005388951A

United States Patent [19]

Tolliver et al.

[11] Patent Number: 5,388,951

[45] Date of Patent: Feb. 14, 1995

[54] PIPE LAYING AND HANDLING APPARATUS AND METHOD

[75] Inventors: Wilber E. Tolliver, Rockford; Larry R. Magnuson, Muskegon, both of Mich.

[73] Assignee: Independent Concrete Pipe Corporation, Indianapolis, Ind.

[21] Appl. No.: 871,484

[22] Filed: Apr. 21, 1992

[51] Int. Cl.[6] ..... B66F 11/00

[52] U.S. Cl. ..... 414/746.5

[58] Field of Search ..... 414/746.5; 29/271, 272

[56] References Cited

U.S. PATENT DOCUMENTS

| | | | |
|---|---|---|---|
| 136,751 | 3/1873 | Nevill . | |
| 597,438 | 1/1898 | Schilling . | |
| 890,453 | 6/1908 | Rice et al. . | |
| 1,510,773 | 10/1924 | Farnsworth . | |
| 1,591,248 | 7/1926 | Tracy . | |
| 1,910,138 | 5/1933 | Van Hooydonk . | |
| 2,841,297 | 7/1958 | Washabaugh | 414/746.5 X |
| 2,954,136 | 9/1960 | Butler et al. | 214/394 |
| 3,258,135 | 6/1966 | Bigge et al. | 214/1 |
| 3,958,704 | 5/1976 | Wire et al. | 214/130 |
| 3,996,778 | 12/1976 | Sparks | 414/746.5 X |
| 4,119,210 | 10/1978 | Desourdy | 214/1 PA |
| 4,143,450 | 3/1979 | Selden et al. | 29/272 |
| 4,476,618 | 10/1984 | Simonson, Jr. | 29/272 |
| 4,480,942 | 11/1984 | Farrow | 405/154 |
| 4,515,522 | 5/1985 | Sonerud | 414/746.5 X |
| 4,685,711 | 8/1987 | Zuber | 294/86.41 |
| 4,934,897 | 6/1990 | Anderson et al. | 414/694 |

*Primary Examiner*—James R. Bidwell

*Attorney, Agent, or Firm*—Price, Heneveld, Cooper, Dewitt Litton

[57] ABSTRACT

An apparatus for lifting a section of precast concrete pipe and for supporting the pipe at an inclined angle to facilitate the bringing together of alignment hardware on the supported section of pipe and on a previously laid section of pipe. The apparatus includes a lifting frame which has two vertically spaced, parallel horizontal legs. An alignment frame, with spaced pipe supporting working faces, is supported on the lower horizontal leg. The alignment frame supports the section of pipe at an inclined angle during the initial alignment and then lowers the section of pipe into full alignment. The alignment frame is supported by a hydraulic system that allows the section of pipe to be lifted, aligned and released. An adjustable lifting point on the upper leg of the lifting frame enables the lifting frame to tilt so the inclined alignment frame is parallel to the inside surface of a pipe section during the initial lift. The mass of the pipe section will then straighten the lifting frame while leaving the pipe section inclined.

38 Claims, 6 Drawing Sheets

PIPE LAYING AND HANDLING APPARATUS AND METHOD

BACKGROUND OF THE INVENTION

When Large sections of precast concrete pipe are to be laid to form a continuous pipe, one or more cranes are used, usually equipped with slings made of steel cable to lift and position the pipe sections. Each concrete pipe section is usually precast with a male connection at one end and a female connection at the opposite end. Typical of these precast connections are the bell-and-spigot and the tongue-and-groove, each of which has a tapered portion for insertion into a shaped recess to form a joint between the pipe sections.

Great care must be taken in maneuvering a large section of precast concrete pipe to avoid damage to the connectors at each end. The bell is usually thinner than the wall of the concrete pipe and the spigot is tapered and has a narrow leading edge. If care is not exercised in bringing the sections of concrete pipe together, it is possible for the bell or spigot to be damaged beyond repair, destroying the entire usefulness of the section of pipe. A tongue-and-groove pipe is also subject to damage in laying contiguous sections. In view of the shape of the bell-and-spigot and the tongue-and-groove, there is no convenient way to cam one pipe section against the other to bring the sections into alignment without risk of serious damage.

Concrete pipes have also been designed with cast-in-place threaded reinforcing rods which are used in combination with washers and nuts to join the pipe sections together. The end of the threaded reinforcing rod would project several inches beyond the end of the pipe and a suitable aperture would be provided in the previously laid pipe for receiving the threaded reinforcing rod in the alignment of the pipes. Care must be exercised in maneuvering this type of precast concrete pipe so as not to bend or strip the threads off the end of the threaded reinforcing rod. If the end of the reinforcing rod is damaged, time must be spent in repairing the rod, if it is capable of being repaired. If the end of the rod is destroyed beyond repair, the entire section of pipe is lost. As in the case of the bell-and-spigot and tongue-and-groove precast concrete pipe, there is no convenient way for aligning the pipe sections using the threaded reinforcing rods without risking damage to the rods.

The lifting and handling of large precast concrete pipe presents multiple problems. For example, the shear mass of the individual pipe sections can lead to serious damage if not properly controlled. Also, the fragile nature of the pipe connectors also requires care so as not to chip an edge or bend a threaded connecting rod.

SUMMARY OF THE INVENTION

The pipe lifting apparatus of the present invention is primarily intended for use with the precast concrete pipe sections and alignment hardware disclosed and claimed in U.S. patent application entitled SHEAR BOLT CONNECTED PRECAST CONCRETE UNITS which was filed on Feb. 26, 1992, and assigned Ser. No. 07/842,086. The inventors are Wilbur E. Tolliver and Larry R. Magnuson, the same inventors of the present application. The content of that patent application is incorporated herein in its entirety.

In accordance with the present invention, an improved apparatus is provided for assembling precast concrete units, such as pipe, decking, wall panels and pavement sections. The precast concrete units include a plurality of spaced longitudinally aligned tubular members. Each end of the concrete unit is substantially flush and is bounded by a rounded edge to reduce the tendency for chipping. The ends of the included tubular members are also preferably flush with the end surfaces of the concrete units. The thus prepared concrete units can be shipped or transported without fear of damage to the alignment apparatus used to join the units together.

When the concrete pipe arrives at the construction site, the apparatus used to align and join the pipe sections together can be installed. In sections of precast concrete box pipe, for example, the tubular members would be cast into the corners of the pipe in the space between the haunch of the pipe and the corner. The ends of each tubular member are preferably internally threaded. A guide member, having a threaded portion and a shaped portion, with a sloping or tapered surface, is threaded into one end of each tubular member in one section of the precast concrete box pipe. The guide member has an axially aligned aperture and a circumferential shear surface on the shaped surface where the guide member abuts the end of the tubular member when threaded into place.

An insert member having an outer threaded surface and an internally threaded axial aperture is threaded into the internally threaded tubular members in a second section of precast concrete box pipe. The sections of pipe are then brought together and the projecting guide surfaces help to align the pipe sections as the guide members enter the end of the tubular member containing the internally threaded insert member. After the two sections of pipe are brought together and aligned, a threaded bolt is passed through the axial aperture in each guide member into the threaded aperture in the insert member. The bolts are tightened to firmly join the two sections of pipe together.

In accordance with the present invention, a lifting apparatus is provided for controllably lifting large precast concrete pipe sections equipped with the alignment hardware previously described. The concrete pipe sections would be supported internally at an inclined angle on the lifting apparatus so that the lifting apparatus can bring the pipe section and alignment hardware into position against a previously laid section of pipe. The camming surface on the upper alignment hardware can be partially inserted into the tubular opening of the alignment hardware on the previously laid concrete pipe section. The pipe section will now be stabilized and the alignment frame in the lifting apparatus can be lowered to bring the pipe section into full alignment. The pipe section will always be under control of the camming surfaces of the upper alignment hardware and then, as the pipe section is lowered, the camming surfaces and lower faces of the concrete pipe come into engagement. Since the concrete pipe has no projecting spigot or tongue section, there is no risk of damage to the concrete pipe itself. If a piece of alignment hardware is damaged, which should be a rare occurrence, the projecting alignment hardware can be unscrewed from the pipe section and replaced with a new camming surface without the concrete pipe itself suffering any damage.

BRIEF DESCRIPTION OF THE DRAWINGS

For a more complete understanding of the present invention, and the advantages thereof, reference is now made to the following descriptions taken in conjunction with the accompanying drawings in which.

DETAILED DESCRIPTION OF THE PREFERRED EMBODIMENTS

Figure 2:
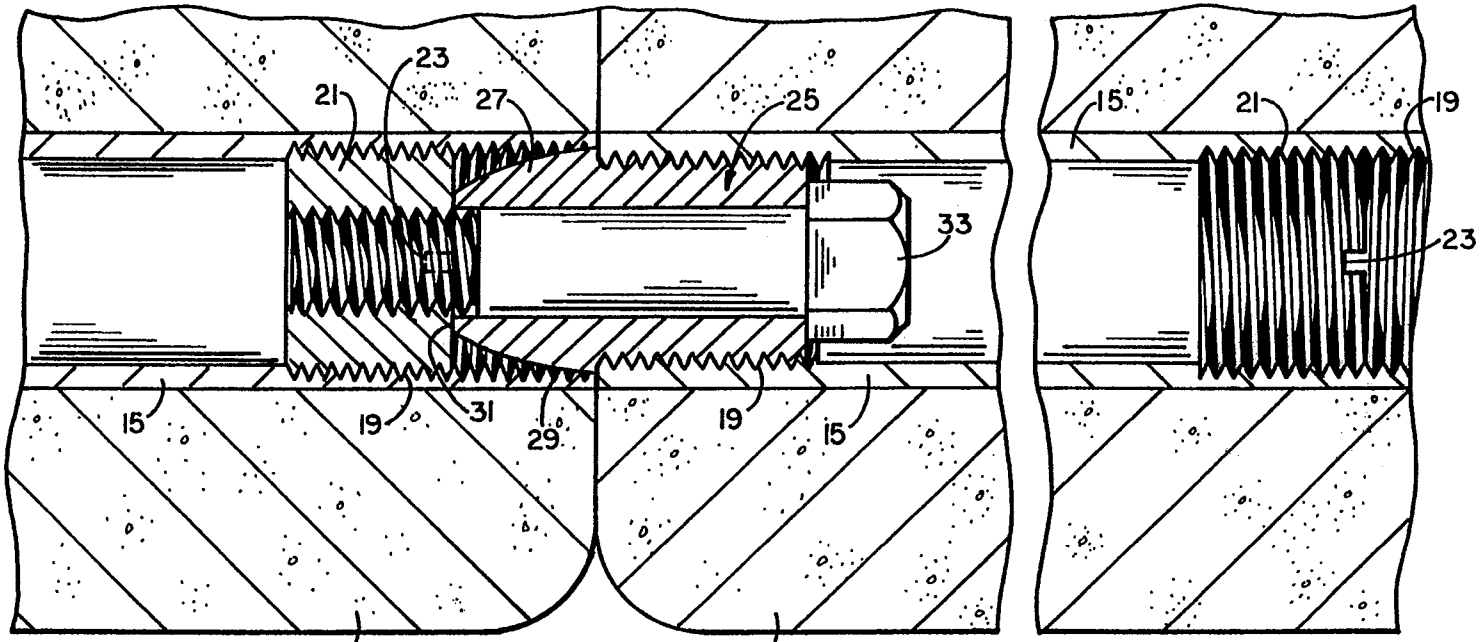
FIG. 2 is an enlarged, fragmentary sectional view of the hardware used to align and fasten the concrete pipes together.
Figure 1:
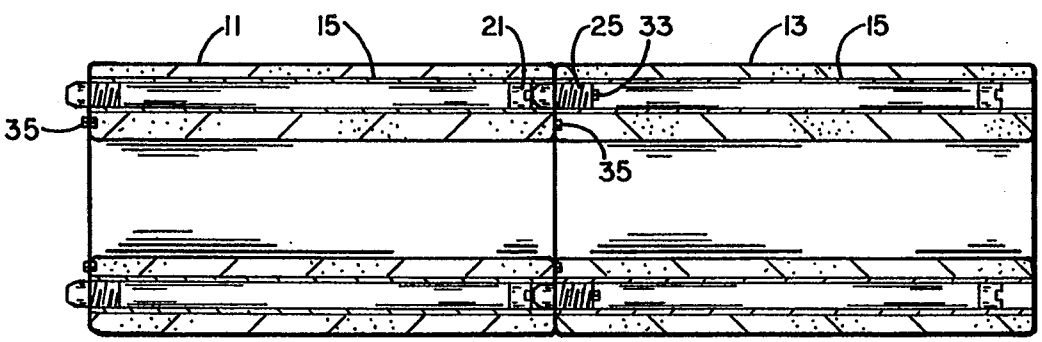
FIG. 1 is a sectional view of two sections of concrete pipe bolted together.
Figure 3:
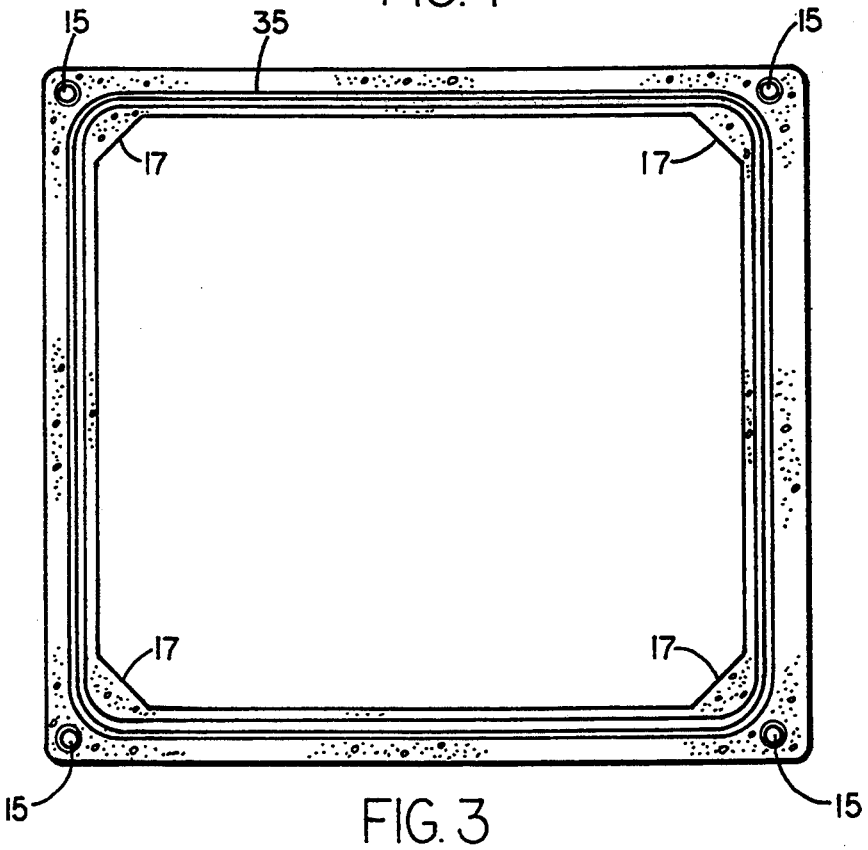
FIG. 3 is an elevational view of an end face on a section of concrete box pipe.

Referring to FIGS. 1 and 2, a first section of concrete pipe 11 is shown bolted to a second section of pipe 13. Now referring to FIG. 3, alone with FIGS. 1 and 2, when the precast concrete pipe is manufactured, substantially identical elongated metal tubes 15 are cast into each corner of the pipe between the outer edge of the corner and the haunch 17. The tubing can be heavy, walled steel which is proportioned to the size of the pipe. For example, in a section of pipe eight feet in diameter, the tubing would be approximately two and one-half inches in outer diameter with a quarter inch wall. Near the end of each tube the inner wall 19 is threaded. Pipe section 11 has a threaded insert 21 screwed into threaded portion 19 of tube 15. Insert member 21 is threaded on the outside and inside. In order to facilitate the insertion of member 21 into the steel tube, a slot 23 is provided in the exposed end for a large screwdriver or other flat bladed-type tool.

In pipe 13, a male alignment member 25 is shown threaded into the end of tube 15. Alignment member 25 has a smooth walled axial aperture therein. The alignment member 25 also has a compound alignment surface having a portion 27 which is in the form of a circumferential band about the surface of the alignment member. This band, the shear band, strengthens the connection between tube 15 and alignment member 25 and resists the shear forces applied by the connected pipes. Adjacent shear band 27 is a sloping bullet-rose-shaped surface 29 which assists in guiding the alignment member into threaded tube 15 on the previously laid piece of concrete pipe. Shaped surface 29 provides a camming surface to facilitate alignment of the pipe sections. The alignment member has a flat face 31 which can abut insert member 21. When the pipe sections are connected together, a threaded bolt 33 is inserted through tube 15 and through alignment member 25 into the threaded aperture in insert member 21. The bolt is then tightened to join the sections of concrete pipe together. After the connection is completed, a threaded insert 21 is screwed into tube 15 behind bolt 33. The process is then repeated to connect the next section of pipe. In order to complete a watertight seal between the pipe sections, a gasket 35 (FIG. 1) can be used.

Figures 5, 9:
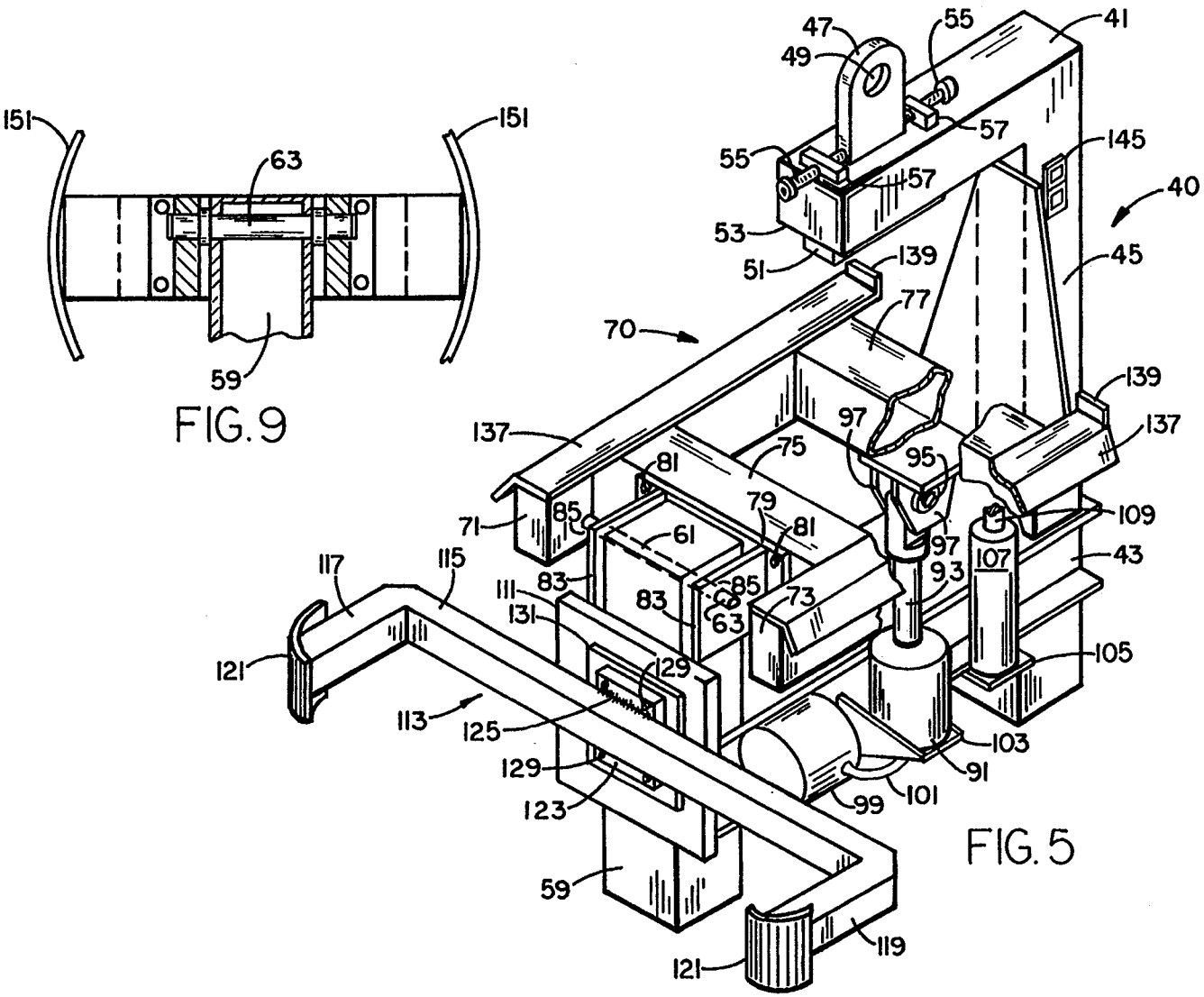
FIG. 5 is a partially broken away, perspective view of the lifting apparatus as used for square concrete box pipe.
FIG. 9 is a sectional view of the apparatus used to lift round concrete pipe.

Turning now to FIG. 5, the apparatus used to lift and align the concrete pipe sections is indicated by the number 40. The apparatus has a C-shaped lifting frame including an upper horizontal leg 41 and second parallel lower horizontal leg 43. Vertical member 45 is used to separate and maintain the alignment between the spaced horizontal legs. Horizontal leg 41 is shorter than horizontal leg 43 and has an adjustable lifting point 47 which has an aperture 49 for receiving a hook or other suitable lifting means. Lifting point 47 has a base 51 against the lower surface 53 of upper horizontal leg 41. A pair of threaded adjusting screws 55 are mounted in blocks 57 and are used to shift lifting point 47 longitudinally within leg 41.

A vertical leg 59 is attached to the distal end of lower horizontal leg 43. Vertical leg 59 extends below horizontal leg 43 and provides a base for the lifting and alignment apparatus. An extended portion of vertical member 45 provides the second base, or rear base, for the apparatus. Vertical leg 59 has an aperture 61, shown in phantom, through which a pivot member 63 passes. Pivot member 63 supports a movable alignment frame indicated by the number 70.

Alignment frame 70 has a first longitudinal leg 71 which is spaced from a second longitudinal leg 73 by transverse members 75 and 77. The longitudinal and transverse members form a rigid frame. Plate 79 is bolted to the vertical face of transverse member 75 by a plurality of spaced bolts 81. Plate 79 supports a pair of spaced flanges 83, each of which contains an aperture 85 through which pivot member 63 extends. Alignment frame 70 is pivotally attached to vertical leg 59 by pivot pin 63. An extensible cylinder 91 has a connecting rod 93 attached to a pivot pin 95 which is supported by a pair of spaced depending flanges 97 from the bottom of rear transverse member 77. Extensible cylinder 91 is preferably a hydraulic cylinder and has a reservoir 99 connected to extensible cylinder 91 by a pipe or reinforced hose 101. Extensible cylinder 91 is supported on a bracket 103 which is attached to the side of lower horizontal leg 43.

A shelf 105 is attached to horizontal leg 43. A spring actuated cylinder 107 is mounted on shelf 105. Spring actuated cylinder 107 has a movable ram 109 which contacts the bottom of transverse member 77.

A plate 111 is attached to the distal end of lower horizontal leg 43 and to the face of vertical leg 59. A horizontal positioning frame 113 is attached to the front of lifting apparatus 40. The horizontal positioning frame has a cross member 115 to which end members 117 and 119 are attached. A pair of substantially identical shoes 121 are attached to the front of members 117 and 119. A plate 123 is welded by a suitable weld 125 to cross arm 115. Plate 123 is attached to plate 111 by a plurality of substantially identical threaded bolts 129. A spacer 131 is placed between plates 123 and 111.

Figure 4:
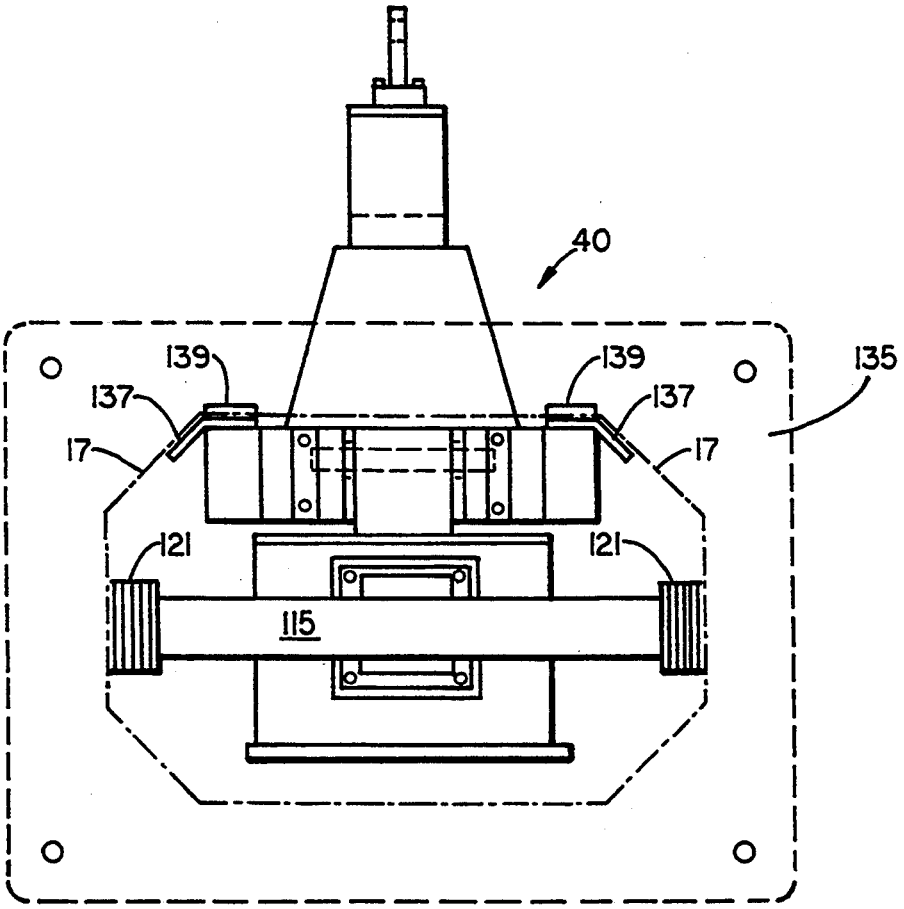
FIG. 4 is a front elevational view of the apparatus used for lifting concrete box pipe.

As shown in FIG. 4, cross arm 115 and shoes 121 serve to position the lifting and alignment apparatus 40 in the center of a section of concrete box pipe 135, shown in phantom in order to more clearly illustrate the lifting and alignment apparatus.

As previously discussed in relation to FIG. 5, longitudinal members 71 and 73, which are joined together by transverse members 75 and 77, form an alignment frame for the concrete pipe sections. A working face 137, for use in lifting concrete box pipe, is mounted on the top of each of the longitudinal members. Each of the working faces has a vertical stop member 139 extending upwardly from the back or rear edge of the working face. Alignment frame 70 supports the section of concrete pipe while positioning frame 113 guides the lifting and alignment apparatus 40 into a previously laid section of concrete pipe.

Figure 6:
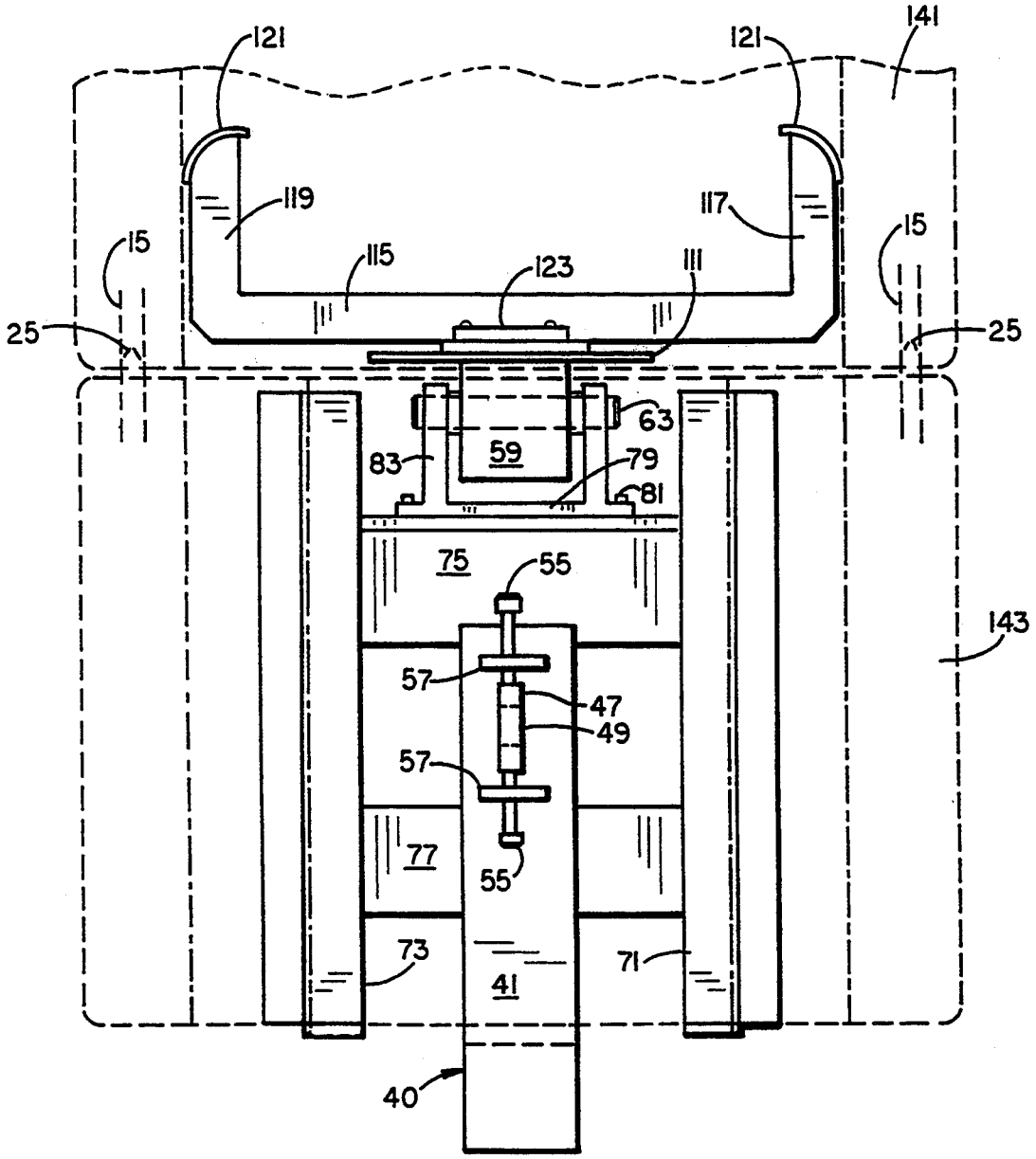
FIG. 6 is a top plan view of the pipe lifting apparatus.
Figure 7:
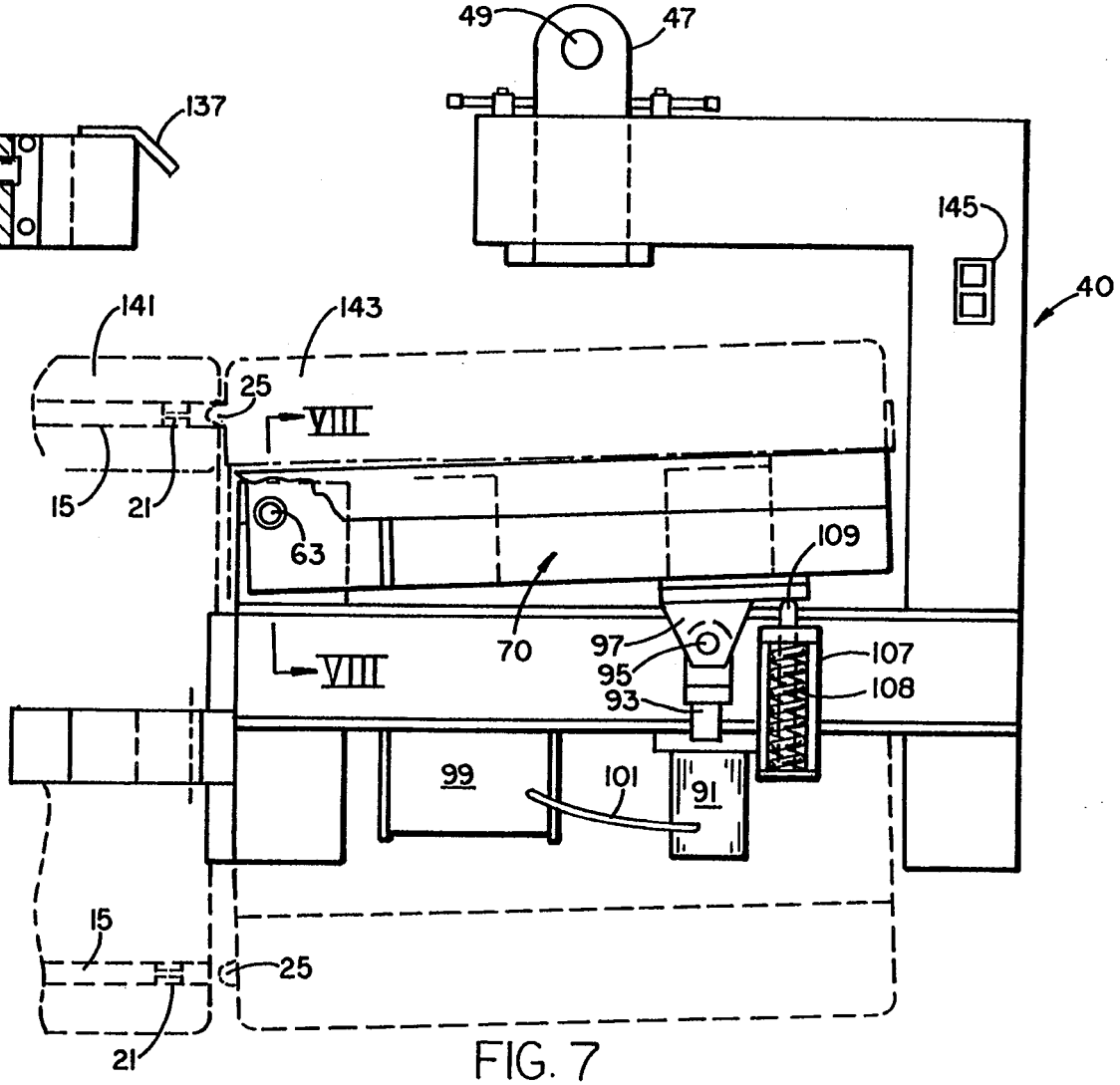
FIG. 7 is a side elevational view of the lifting apparatus shown aligning a section of concrete pipe with a previously laid section.

Turning now to FIGS. 6 and 7, a portion of a section of concrete pipe 141 is shown after it has been laid in assembling a continuous pipe. Section 141 has cast-in-place tubes 15 at the top and bottom with a threaded insert 21 in place. The next section of concrete pipe to be laid, 143, is supported on lifting and alignment apparatus 40. The section of concrete pipe has the same precast tubes 15 in which are mounted male alignment members 25 extending from the front face of the section of pipe. In order to facilitate the alignment of the pipe, alignment frame 70 is pivoted upwardly approximately 2° so that upper alignment members 25 will first come into contact with the previously laid section of pipe 141. Alignment and lifting apparatus 40 is then moved toward concrete pipe section 141. The horizontal positioning frame 113, along with guide shoes 121, enters the interior of pipe 141, positioning the lifting and alignment apparatus and supported pipe section. Male alignment members 25 can then be brought into contact with the threaded ends of tubes 15 in the upper portion of pipe 141. Camming surfaces 29 (FIG. 2) contact the edges of tubes 15 and precisely aligns the top of the concrete pipe section 143 with previously laid pipe section 141. Once the top of the pipe is positioned, a control switch 145, on the side of vertical leg 45, is operated which causes the hydraulic fluid contained in extensible cylinder 91 to either flow from one side of the piston to the opposite side as the piston lowers in the cylinder or to drain into reservoir 99, lowering alignment frame 70, and bringing alignment hardware 25 at the bottom of concrete pipe section 143 into alignment. The threaded bolts can then be passed through tubes 15 and pipe section 143, to bolt sections 143 and 141 together. After the pipe is securely fastened together, lifting and alignment apparatus 40 can be backed out of concrete pipe section 143 and moved over to pick up a new section of concrete pipe to repeat the process.

When the weight of concrete pipe section 143 is removed from alignment frame 70, spring actuated cylinder 107 causes ram 109 to extend, lifting alignment frame 70 approximately 2° to the tilted or alignment position. When alignment frame 70 is supported by ram 109, the hydraulic fluid can circulate within the extensible cylinder from one side of the piston to the other or it can return from reservoir 99 to extensible cylinder 91 where it is confined, preparing the lifting and alignment apparatus to receive the next piece of pipe. No pumps are used in the transfer of the hydraulic fluid. The mass of the concrete pipe and alignment frame 70 pushes the hydraulic fluid out of the cylinder as the piston lowers. The fluid returns to the extensible cylinder when spring actuated cylinder 107 again raises alignment frame 70. The preferred construction for the spring actuated cylinder 107 includes a stack of Belleville springs 108. The number and size of the Belleville springs can be determined experimentally, depending on the mass of the alignment frame.

When the lifting and alignment frame is removed from the connected section of concrete pipe, lifting and alignment frame 70 will tilt upwardly in preparation for moving into the next section of concrete pipe to be laid. Lifting point 47, on upper leg 41, can be moved by adjusting screws 55 so that the lifting frame is properly aligned for the next section of pipe to be lifted. The alignment frame can be moved into the next section of pipe until vertical stops 139, on each working face 137, stop the movement.

In order to raise and position different size pieces of precast concrete pipe, alignment frame 70 and positioning frame 113 are preferably removed from lifting and alignment apparatus 40 and replaced by the proper sized units to match the sections of pipe to be laid. This is the preferred method of changing the lifting and alignment apparatus to handle different size pipe. Since the pipe size rarely changes in laying a length of pipe, this is not a problem. For lighter sections of pipe, it is within the scope of the present invention to have the positioning and alignment frames adjustable in width to avoid the time and expense of replacing both units.

Figure 8:
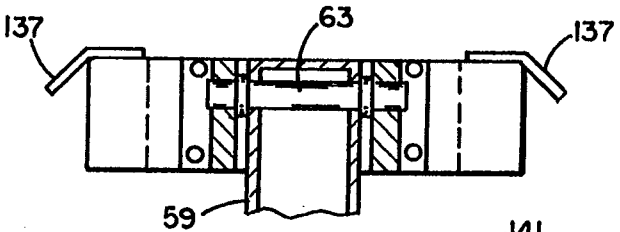
FIG. 8 is a sectional view of the lifting apparatus used for box pipe.

Referring to FIGS. 4 and 8, working faces 137 are shaped to fit against the upper surface of the interior of the pipe and against a portion of the haunch. By so positioning the alignment frame, the force is uniformly applied upwardly against the top surface of the pipe and outwardly toward the sides. The lifting and alignment apparatus can also be used with round pipe (FIG. 9) where working faces 151 would be sector-shaped to contact opposed inner walls of the round concrete pipe. The round concrete pipe would employ the same alignment and joining hardware, as previously described for the square concrete pipe.

Figure 11:
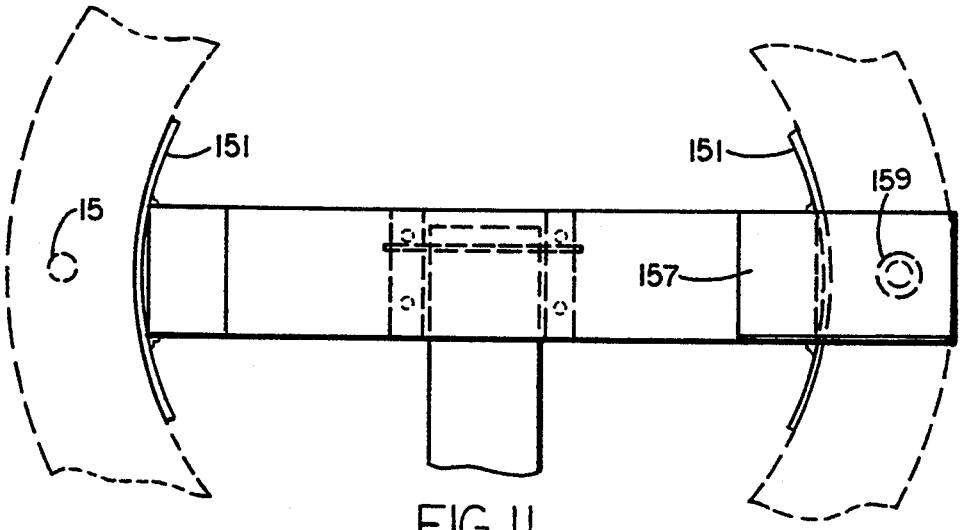
FIG. 11 is a fragmentary end elevational view of the pipe lifting apparatus of FIG. 10 looking in the direction of the line II—II.
Figure 10:
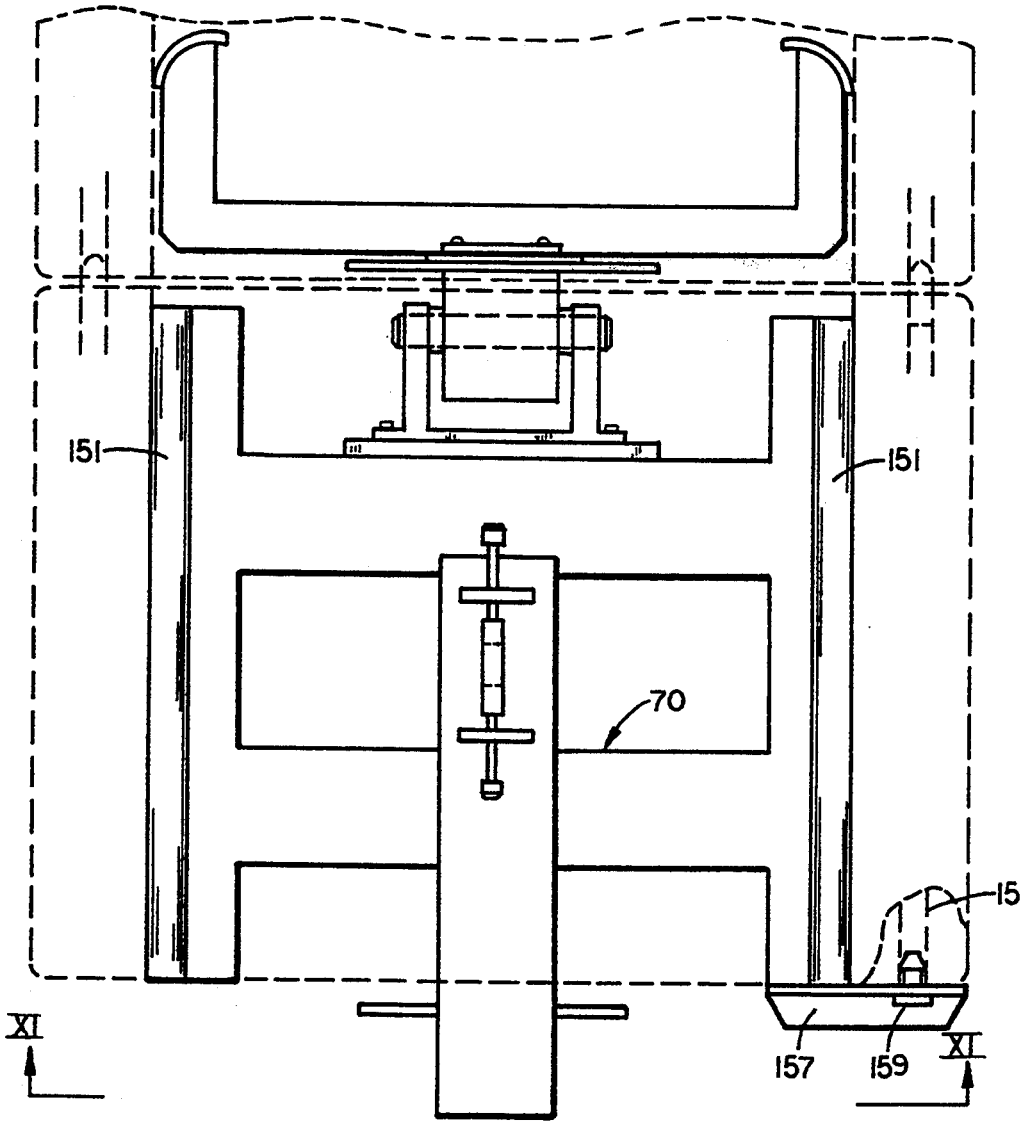
FIG. 10 is a plan view of a section of round concrete pipe on the lifting apparatus with an alignment pin in place.

When a section of concrete box pipe is lifted, the alignment frame is positioned against the sides and top of the pipe which results in the proper orientation of the alignment hardware. On the other hand, when a section of round pipe is lifted, there are no corners to use in positioning the alignment hardware. Referring now to FIGS. 10 and 11, a stop plate 157 is shown attached to the end of sector 151 which is used to lift round pipe. Stop plate 157 prevents lifting frame 70 from entering too deeply into the pipe section. Stop plate 157 properly positions the section of pipe on lifting frame 70. An alignment or locating pin 159 is mounted on stop plate 157. The alignment pin enters into one of the threaded tubes 15 which are embedded in the concrete pipe. By locating or positioning one of the tubes 15, all of the tubes and their in-place alignment hardware are properly positioned relative to the last section of pipe laid.

The lifting and alignment apparatus of the present invention, in combination with the alignment and joining hardware, enable large sections of pipe to easily be brought into alignment and bolted together substantially speeding up the process of laying a concrete pipe.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. An apparatus for lifting and aligning a section of precast concrete pipe comprising:

lifting means for lifting a section of precast concrete pipe, said lifting means including a first frame, said first frame being C-shaped and defining a space for receiving a portion of the section of precast concrete pipe; and alignment means including a second frame movably connected to said first frame of said lifting means for supporting a section of concrete pipe at an angle relative to said lifting means.

2. An apparatus for lifting and aligning a section of precast concrete pipe as set forth in claim 1, including:

support means on said lifting means for holding said alignment means at an inclined angle relative to said lifting means during the initial alignment of a section of concrete pipe and for lowering said alignment means and a supported section of concrete pipe into final position when the section of concrete pipe is aligned.

3. An apparatus for lifting and aligning a precast section of concrete pipe as set forth in claim 1, wherein said first frame comprises:

a first horizontal leg;

a second horizontal leg vertically spaced from and parallel to said first horizontal leg, said first horizontal leg including structure defining a lifting point; and a vertical member joining an end of each of said first and second horizontal legs into a unitary structure.

4. An apparatus for lifting and aligning a precast section of concrete pipe as set forth in claim 3, wherein said second horizontal leg is below and longer than said first horizontal leg.

5. An apparatus for lifting and aligning a section of precast concrete pipe as set forth in claim 1, wherein said alignment means includes at least two working faces configured to conform to a portion of the inner configuration of a section of precast concrete pipe.

6. An apparatus for lifting and aligning a section of precast concrete pipe as set forth in claim 5, wherein said working faces have angular surfaces to substantially conform to the inner corners of a section of concrete pipe.

7. An apparatus for lifting and aligning a section of precast concrete pipe as set forth in claim 5, wherein said working faces are arcuate sectors to conform to a portion of the inner surface of a round concrete pipe.

8. An apparatus for lifting and aligning a section of precast concrete pipe as set forth in claim 5, wherein said working faces include at least one stop plate for positioning said working faces in said concrete pipe.

9. An apparatus for lifting a section of precast concrete pipe as set forth in claim 1, including means for horizontally positioning said lifting means relative to a previously positioned section of concrete pipe, said means for horizontally positioning being connected to said alignment means and including a surface adapted to contact the previously positioned section of precast concrete pipe to align the apparatus therewith.

10. An apparatus for lifting and aligning a section of precast concrete pipe as set forth in claim 9, wherein said horizontal positioning means includes:

an elongated cross member attached to the front of said lifting means; and a contact surface at each end of said cross member for contacting the inner surface of a section of precast concrete pipe.

11. An apparatus for lifting and aligning a section of precast concrete pipe comprising:

lifting means for lifting a section of precast concrete pipe, said lifting means including a first horizontal leg and an adjustablee lifting member on the upper surface of said first horizontal leg for varying the angle at which said lifting member hangs when supported; and alignment means on said lifting means for supporting a section of concrete pipe at an angle relative to said lifting means.

12. An apparatus for lifting and aligning a section of precast concrete pipe comprising:

lifting means for lifting a section of precast concrete pipe; and alignment means on said lifting means for supporting a section of concrete pipe at an angle relative to said lifting means, said alignment means including at least two working faces configured to conform to a portion of the inner configuration of a section of precast concrete pipe, said working faces having angular surfaces to conform to the top and adjoining haunch of a section of precast concrete box pipe.

13. An apparatus for lifting and aligning a section of precast concrete pipe comprising:

lifting means for lifting a section of precast concrete pipe;

alignment means on said lifting means for supporting a section of concrete pipe at an angle relative to said lifting means, said lifting means comprising:

a hydraulic cylinder supported by said alignment means and attached to said lifting means;

a supply of hydraulic fluid for said hydraulic cylinder;

a spring actuated piston for returning said hydraulic cylinder to the extended position after it has been lowered; and a control means for circulating said hydraulic fluid in said hydraulic cylinder to enable said alignment means to descend.

14. An apparatus for lifting and aligning a section of precast concrete pipe as set forth in claim 13, including:

a reservoir for said hydraulic fluid; and a control means for draining said hydraulic fluid from said hydraulic cylinder into said reservoir when said alignment means is lowered and for enabling said hydraulic fluid to return from said reservoir to said hydraulic cylinder when said hydraulic cylinder is extended by said spring actuated piston.

15. An apparatus for lifting and aligning a section of precast concrete pipe comprising:

lifting means the lifting a section of precast concrete pipe;

alignment means on said lifting means for supporting a section of concrete pipe at an angle relative to said lifting means; and a spring actuated piston operably connected to said alignment means, said spring actuated piston including a plurality of stacked Belleville springs operably connected thereto for biasing said piston in a particular direction.

16. An apparatus for lifting and aligning a section of precast concrete pipe comprising:

lifting means for lifting a section of precast concrete pipe;

alignment means on said lifting means for supporting a section of concrete pipe at an angle relative to said lifting means, said alignment means including at least two working faces configured to conform to a portion of the inner configuration of a section of precast concrete pipe, said working faces including at least one stop plate for positioning said working faces in said concrete pipe; and at least one alignment pin, for orienting round concrete pipes, attached to said at least one stop plate.

17. An apparatus for lifting precast concrete units comprising:

a lifting frame including an upper horizontal leg and a lower horizontal leg, said lower horizontal leg being positioned below and parallel to said upper horizontal leg, and a vertical leg joining one end of said upper horizontal leg and said lower horizontal leg into an integral assembly;

an upstanding pivot support mounted on said lower horizontal leg near the distal end thereof;

an alignment frame pivotally attached to said upstanding pivot support, said alignment frame including:

a first transverse member extending across the said lower horizontal leg;

a second transverse member spaced from and parallel to said first transverse member, extending across said lower horizontal leg;

a first lifting member extending parallel to said lower horizontal leg and attached to one end of said first and second transverse members;

a second lifting member extending parallel to said lower horizontal leg and attached to the other end of said first and second transverse members;

a lifting face attached to each of said first and second lifting members; and a pivoting means on said lower horizontal leg of said lifting frame for holding said alignment frame and a supported concrete unit at an inclined angle for initial alignment of said concrete unit and for lowering said alignment frame and said concrete unit for connecting of said concrete unit to a previously positioned concrete unit.

18. An apparatus as set forth in claim 17, wherein said lifting faces are configured to conform to the lifting surfaces on said concrete unit.

19. An apparatus as set forth in claim 17, wherein said concrete unit is a precast section of round pipe and said lifting faces are sectors to grip opposed inner surfaces of said pipe.

20. An apparatus as set forth in claim 17, wherein said concrete unit is a precast section of rectangular pipe and said lifting faces are configured to contact the upper inner surface and the surface of a haunch in the corner of said pipe.

21. An apparatus as set forth in claim 17, wherein said pivoting means includes:

a hydraulic cylinder depending from said alignment frame and having a movable piston attached operatively connected to said lower horizontal leg for holding said alignment frame at an inclined angle relative to said lifting frame and for controllably lowering said alignment frame to a horizontal plane;

lifting means for raising said alignment frame to an inclined angle relative to said lifting frame.

22. An apparatus as set forth in claim 21, wherein said lifting means is a spring actuated piston which extends when the pressure of said concrete unit is relieved from said alignment frame.

23. An apparatus as set forth in claim 22, wherein said spring actuated piston is caused to move by a plurality of Belleville springs.

24. An apparatus as set forth in claim 17, wherein at least one stop plate is on a lifting face.

25. An apparatus as set forth in claim 24, wherein a locating pin is provided on said at least one stop plate.

26. A method of aligning a section of precast concrete pipe with a previously positioned section of concrete pipe comprising the following steps:

providing a lifting means for a section of pipe;

providing an alignment means on said lifting means for supporting a section of concrete pipe at an inclined angle relative to said lifting means;

providing alignment hardware on both sections of concrete pipe;

moving said section of pipe to the already positioned section of pipe while supporting said section of pipe at an angle;

bringing the alignment hardware on the upper portion of each section of pipe into position; and lowering said alignment means relative to said lifting means to bring the lower alignment hardware on said pipe sections into position.

27. A method for aligning sections of precast concrete pipe as set forth in claim 26, wherein the step of lowering said alignment means causes said alignment hardware on the upper portions of said pipes to cause the lower portion of said supported pipe to move into position against said previously positioned section of pipe.

28. A method for aligning sections of precast concrete pipe as set forth in claim 26, including the step of providing a resilient gasket on the face of one of said pipe sections to provide a resilient gasket between said pipe sections when they are joined together.

29. A method as set forth in claim 26 wherein said alignment hardware on said sections of concrete pipe includes a male member on one of said sections and a recess on the other of said sections for receiving said male member, and wherein said step of bringing the alignment hardware into position includes extending said male member into said recess.

30. A method as set forth in claim 26 wherein said alignment hardware includes a pair of male members and a pair of recesses for receiving said pair of male members, and wherein said step of bringing the alignment hardware into position includes extending said pair of male members into said pair of recesses.

31. A method of aligning a second section of pipe with a previously positioned first section of pipe, said second section and said previously positioned first section each having ends including a top and a bottom, comprising the following steps:

advancing said second section of pipe towards said first section of pipe while maintaining said second section of pipe oriented at an inclined angle relative to the longitudinal axis of said first section of pipe:

aligning and engaging said top of said second section of pipe with said top of said first section of pipe so that said bottoms of said first and second sections or pipe are spaced apart; and pivoting said second section of pipe about said aligned and engaged tops of said first and second sections of pipe until said bottoms of said first and second sections of pipe engage.

32. A method as set forth in claim 31 including securing said first section and said second section together to form an interconnected unit.

33. A method as set forth in claim 31 wherein one of said first and second sections of pipe includes a male member at said top thereof and the other of said first and second sections of pipe includes a recess at said top thereof for receiving said male member, and wherein said step of engaging includes extending said male member into said recess.

34. A method as set forth in claim 33 wherein said male member includes bullet-nose-shaped end and said recess is configured to mateably receive said bullet-nose-shaped end, and wherein said step of engaging includes extending said bullet-nose-shaped end into said recess.

35. A method as set forth in claim 31 in which said first and second sections of pipe are precast pipe, and wherein said method includes:

providing cooperating alignment means at the tops of said first and second sections of pipe;

said engaging step comprising engaging said cooperating alignment means; and securing said one section of pipe and said previously positioned section of pipe together to form an interconnected unit by use of said cooperating alignment means.

36. A method as set forth in claim 35 wherein said cooperating alignment means includes a male member and a recess for receiving said male member, and wherein said step of engaging includes extending said male member into said recess.

37. A method as set forth in claim 36 including steps of providing a resilient gasket on the face of one of said sections of pipe to provide a resilient gasket between said sections when they are joined together, and wherein said step of securing includes sealing a joint formed by said section with said resilient gasket.

38. A method as set forth in claim 31 wherein said tops of said first and second sections of pipe engage in at least two locations which are spaced apart, said two locations defining an axis of rotation, and wherein said step of pivoting includes pivoting said second section about said axis of rotation.

* * * * *